US011152146B2

(12) United States Patent
Canete Cabeza et al.

(10) Patent No.: US 11,152,146 B2
(45) Date of Patent: Oct. 19, 2021

(54) ANNULAR MAGNETIC POWER UNIT

(71) Applicant: PREMO, S.A., Malaga (ES)

(72) Inventors: Claudio Canete Cabeza, Benalmadena (ES); Raquel Rodriguez, Estepona (ES); Marina Arcos Moreno, Malaga (ES); Francisco Ezequiel Navarro Perez, Barcelona (ES); Hector Perdomo Diaz, San Cristobal de la Laguna (ES); Juan Manuel Codes Troyano, Rincon de la Victoria (ES)

( * ) Notice: Subject to any disclaimer, the term of this patent is extended or adjusted under 35 U.S.C. 154(b) by 517 days.

(21) Appl. No.: 16/205,922

(22) Filed: Nov. 30, 2018

(65) Prior Publication Data

US 2019/0164679 A1 May 30, 2019

(30) Foreign Application Priority Data

Nov. 30, 2017 (EP) ..... 17382811

(51) Int. Cl.

| | |
|---|---|
| ***H01F 27/24*** | (2006.01) |
| ***H01F 3/14*** | (2006.01) |
| ***H01F 27/32*** | (2006.01) |
| ***H01F 27/28*** | (2006.01) |
| ***H01F 30/16*** | (2006.01) |

(Continued)

(52) U.S. Cl.

CPC ..... *H01F 27/24* (2013.01); *H01F 3/14* (2013.01); *H01F 17/06* (2013.01); *H01F 27/2804* (2013.01); *H01F 27/306* (2013.01); *H01F 27/327* (2013.01); *H01F 27/40* (2013.01); *H01F 30/16* (2013.01); *H01F 27/2847* (2013.01); *H01F 2027/2809* (2013.01)

(58) Field of Classification Search

CPC ..... H01F 27/24; H01F 3/14

See application file for complete search history.

(56) References Cited

U.S. PATENT DOCUMENTS 3,238,484 A * 3/1966 Dacey ..... H01F 17/062 336/178

4,210,859 A * 7/1980 Meretsky ..... G11C 11/08 323/331

(Continued)

FOREIGN PATENT DOCUMENTS

DE 29702644 U1 5/1997

EP 1536436 A1 * 6/2005 ..... H01F 27/022

(Continued)

*Primary Examiner* — Elvin G Enad

*Assistant Examiner* — Malcolm Barnes

(74) *Attorney, Agent, or Firm* — Eugenio J. Torres-Oyola; Victor M. Rodriguez-Reyes; Rafael Rodriguez-Muriel

(57) ABSTRACT

The proposed annular magnetic power unit includes an annular magnetic core comprising a first partial magnetic core and a second partial magnetic core, overlapped and facing to each other, the first and second partial magnetic cores being divided by two parallel air-gaps in a first and second central magnetic core portion, a first and second left side core portion and in a first and second right side core portion; the annular power unit also including at least one electro-conductive inner coil included within an annular groove of the annular magnetic core; and left and right independent electro-conductive outer coils wound around the first and second left side core portions and the first and second right side core portions respectively.

10 Claims, 2 Drawing Sheets

(51) Int. Cl.

| | |
|---|---|
| ***H01F 27/30*** | (2006.01) |
| ***H01F 17/06*** | (2006.01) |
| ***H01F 27/40*** | (2006.01) |

(56) References Cited

U.S. PATENT DOCUMENTS

| | | | | |
|---|---|---|---|---|
| 2013/0009737 | A1* | 1/2013 | Rocke ..... | H01F 30/12<br>336/10 |
| 2019/0019613 | A1* | 1/2019 | Navarro Perez ..... | H01F 27/08 |

FOREIGN PATENT DOCUMENTS

| | | | |
|---|---|---|---|
| EP | 1303800 | B1 | 8/2006 |
| EP | 3319096 | A1 | 9/2018 |
| ES | 2197830 | A1 | 1/2004 |

* cited by examiner

ANNULAR MAGNETIC POWER UNIT

TECHNICAL FIELD

The present invention refers to an integrated annular magnetic power unit comprising a hollow annular magnetic core having an inner passage there through, two independent outer coils wound around said hollow annular magnetic core, that provide two independent inductors, and one or more inner coils wound around the inner passage of the hollow annular magnetic core, providing for example a power transformer.

The inner coil or coils are fully enclosed within the hollow annular magnetic core, achieving a better performance and a compact construction and significantly reducing the inductance leakage because the magnetic field remaining confined in the referred inner passage.

The object of this invention is also to provide a planar transformer of very small size and with a large capacity for insulation between layers, specifically between windings, offering the further possibility that they may be manufactured economically. This planar transformer will be placed within cited inner passage, This magnetic power unit is particularly adapted to be used for example as a power transformer or inductor in the electrical power field, suitable for operating a high power electrical device, especially usable in the field of hybrid and electrical vehicles (HEVs) that nowadays is growing quite fast. The new models of electrical vehicles require more and more power electronics inside, not only for the electrical motor supply with speed and torque control, but also for high-voltage (HV) battery chargers and stable in-car continuous low-voltage (LV) power supplies. In an embodiment, the proposed magnetic power has been designed for an interconnecting box between HV battery and HV component in an electrical vehicle.

The hollow annular magnetic power unit of this invention responds to a new volumetric efficiency concept on magnetic units providing a very high performance in $W/cm^3$.

It will be understood along this description that references to geometric position, such as parallel, perpendicular, tangent, etc. allow deviations up to ±5° from the theoretical position defined by this nomenclature.

STATE OF THE ART

U.S. Pat. No. 4,210,859 discloses an inductive device comprising a magnetic core and windings for producing two (see FIGS. 1 to 3) substantially orthogonal magnetic fields at all points within the core. A typical pot core is illustrated in FIG. 1. The core, which may be made of ferrite, magnetic iron steel or some other ferromagnetic material, comprises an outer cylindrical pot wall 30, a center post 32 and a pot cover 34. An annular space 40 is formed between the pot wall 30 and the center post 32. In this space is arranged a bobbin (not shown) which supports one or more coils of suitably dimensioned electrical wire. Since the post hole 36 and cover hole 38 may be considered to be the central hole of a toroid, it is possible to provide the pot core with an additional winding which passes through the central hole in one direction and back around the outside of the pot wall 30. Such a winding will be a type A winding because it is not completely enclosed by the pot core material.

This cited document does not describe how to include multiple outer windings around the annular magnetic core preventing the interference between the magnetic fields generated by said outer windings.

European patent applications, of the same applicant, EP16002354 (FIG. 5) and EP17382450, not yet published at the time of filing of this application, disclose a compact magnetic power unit having an annular pot shaped magnetic core with an inner housing inside of which a coil is wound.

The European patent application of the same applicant EP17382450 describes two coils wound around the magnetic core externally, in opposite portions of the annular magnetic core, and the inner passage of the annular magnetic core having a partition wall therein (see reference 5 in FIG. 7), reducing the magnetic interference between both outer coils wound around the magnetic core, having the magnetic core no interruption between the portion where one outer coil is wound and the other portion where the other outer coil is wound, the magnetic interference will be produced, and the efficiency reduced.

None of the two cited documents of the same applicant describes how to include multiple outer windings around an annular magnetic core preventing the interference between the magnetic fields generated by said multiple outer windings.

Document ES2197830 describes a planar transformer of very small size and with a large capacity for insulation between layers made with stacked layers of printed circuit board windings and copper windings with insulating layers in-between.

The present invention further develops the proposal of said embodiment, and includes embodiments with two annular axial coils, separated and electrically isolated, wound around the hollow annular magnetic core.

BRIEF DESCRIPTION OF THE INVENTION

The present invention corresponds to an annular magnetic power unit.

According to the state of the art, and as per the teaching of the cited EP17382450 of the same applicant, this type of annular magnetic power units includes:

- an annular magnetic core defining an inner passage and an annular groove, said annular magnetic core comprising a first partial magnetic core and a second partial magnetic core, overlapped and facing to each other, at least said first partial magnetic core having a first annular groove constitutive of said annular groove, accessible through a surface of the first partial magnetic core facing the second partial magnetic core, said first annular groove surrounding the inner passage;
- at least one electro-conductive inner coil included within the annular groove (30 FIG. 3);
- at least one electro-conductive outer coil (40, FIG. 3) wound around the annular magnetic core passing through the inner passage (2, FIG. 3).

The annular magnetic core is an element made of a material with a high magnetic permeability with the ability to confine and guide magnetic fields having a through hole named inner passage, and having an annular configuration around said inner passage.

The annular magnetic core includes therein an annular groove where said at least one electro-conductive inner coil is encapsulated, surrounded by the annular magnetic core, providing a choke configuration.

To make this annular groove accessible during its assembly the annular magnetic core is formed by at least two different partial magnetic cores, corresponding to first and second partial magnetic cores, assembled together by an attachment as a composed core in a layered configuration, being the interior of the annular groove accessible when the first and second partial magnetic cores are detached.

Each outer coil will be a coil wound passing each turn through the inner passage surrounding the annular magnetic core and providing an inductor configuration.

The presence of two outer coils wound around the annular magnetic core allows the use of said inductor configuration with different and independent circuit functions as the magnetic field flux they share is neglectable they work as two independent toroidal windings 43 and 44 FIG. 3 with a closed magnetic circuit working as a toroidal choke that is formed by both half cores 20 and 10 FIG. 3.

Planar winding 30 FIG. 3 with Upper core block 10 FIG. 3 and Lower core block 20 FIG. 3 work as low leakage induction planar transformer.

External winding 43 FIG. 3 wound around the annular core built with upper core block 13 and 11 FIG. 3 and lower core block 23 and 21 FIG. 3 work as an independent toroidal inductor/choke. Equally external winding 44 FIG. 3 wound around the annular core built with upper core block 14 FIG. 3 and 11 FIG. 3 and lower core block 24 FIG. 3 and 21 FIG. 3 work as an independent toroidal inductor/choke.

In another embodiment winding 44 or winding 43 or both could be replaced by multiple windings thus building one or both transformers or coupled inductors instead.

The magnetic fields generated by the inner coil and the outer coils do not interfere with each other because they are perpendicular to each other.

On said basic structure the present invention further proposes the following features:

- Said at least one electro-conductive outer coil are two independent electro-conductive outer coils named left and right independent electro-conductive outer coils.
- The first partial magnetic core is divided by two parallel air-gaps in three independent parts corresponding to a first central magnetic core portion, defined between said two parallel air-gaps, to a first left-side core portion and to a first right-side core portion placed on both sides of said first central magnetic core portion. Both mentioned parallel air gaps are intended to maximize Magnetic Reluctance of the core and reduce mutual coupling between both external toroidal coils 44 and 46 in FIG. 1.
- The second partial magnetic core is also divided by said two parallel air-gaps (50) in three independent parts corresponding to a second central magnetic core portion, defined between said two parallel air-gaps, to a second left-side core portion and to a right-side core portion placed on both sides of said second central magnetic core portion.
- The two-parallel air-gaps are defined on gap planes perpendicular to a surface of the first partial magnetic core facing the second partial magnetic core, both parallel air-gaps being communicated with the inner passage.
- The first central magnetic core portion and the second central magnetic core portion define correspondent first and second bridges across the inner passage, dividing said inner passage in a left inner passage and a right inner passage; and wherein the left electro-conductive outer coil passes through the left inner passage and surrounds the first and second left side core portions; and the right electro-conductive outer coil passes through the right inner passage and surrounds the first and second right side core portions.

In other words, the first and second partial magnetic cores are each divided in three parts, being said parts spaced apart by two parallel air-gaps defined by two parallel gap planes. Said two gaps interrupt the magnetic path generated in the annular magnetic core by the two independent outer coils, preventing interferences and inefficiencies generated to each other. Therefore, this arrangement provides two tangential and parallel magnetic fields which do not interfere, and which are perpendicular to the magnetic field of the inner coil housed in the inner passage of the hollow annular magnetic core.

Moreover, the arrangement of the air-gaps also increases the reluctance so that each of the magnetic fields of the independent outer coils close without interfering among them.

The left outer coil is wound around the first and second left side core portions generating a magnetic field therein, the right outer coil is wound around the first and second right side core portions generating a magnetic field therein, and the first and second magnetic core portions are placed in-between and spaced apart from the left and right-side core portions by said two air-gaps, separating both magnetic fields and preventing interferences. At the same time said two parallel air-gaps does not interfere in the magnetic fields generated by the inner coil because said air-gaps are parallel to the magnetic field generated by said inner coil.

The two parallel gap planes are partially coincident with the inner passage in such a way that the gaps created in the annular magnetic core communicate with said inner passage.

Each first and second central magnetic core portions have a bridge crossing the inner passage in such a way that said first, or second central magnetic core portions are a single piece. Said bridge divide the inner passage in a left inner passage and a right inner passage.

According to a preferred embodiment of the present invention, the electro-conductive inner coil will provide a planar transformer applying advantageously the technical solution disclosed in WO2004003947 of the same applicant, and to this aim it is constituted by a succession of windings comprising a variable number of stacked printed circuit board windings and/or copper windings with interleaved insulating laminar members in contact with all the surfaces of the windings said stacked windings being connected together. This construction and arrangement of the inner coil within the hollow annular magnetic core assures a compact and planar winding with a high performance and significantly reduces the induction leakage.

Each copper winding could be a copper sheet having a sinuous slit or a winded copper coil. The copper sheet with the sinuous slit could be punched from a sheet, producing the winding configuration.

Each printed circuit board winding can include a sinuous conductive circuit configured as a winding printed on one or both sides of said printed circuit board.

The connection between said stacked windings is preferably produced by connecting pins inserted through aligned orifices of the printed circuit board windings and the copper windings.

The second partial magnetic core is proposed to have a second annular groove also constitutive of said annular groove, accessible through a surface of the second partial magnetic core facing the first partial magnetic core, said second annular groove surrounding the inner passage. According to this proposal the annular groove is formed by the superposition of the first and the second annular grooves. Preferably the first and second partial magnetic cores are symmetric to each other.

According to another embodiment the left electro-conductive outer coil is different from the right electro-conductive outer coil, and therefore having different performance.

Using the left outer coil, the right outer coil or both simultaneously different performance of the annular magnetic power unit can be achieved.

The annular magnetic core, the left and right independent electro-conductive outer coils, and the electro-conductive inner coil are preferably embedded in a single mass of insulating polyurethane resin which covers the assembly. According to this feature the annular magnetic power unit is totally electrically isolated and undue modifications or accidental disassembly are prevented.

The use of two independent outer coils allow the use of the annular magnetic power unit as an inductor with different levels of performance, using one, the other or both outer coils, especially if both outer coils are different to each other. In the particular embodiment that will be following disclosed one of the outer coil will operate as resonant inductor while the second outer coil operates as parallel external inductor and the inner passage houses a planar transformer.

This configuration including the inner coil and two outer coils uses the soft magnetic core more efficiently three independent components, that with conventional technology would use one independent magnetic core each, are here wound on just one magnetic device that behaves as three independent electric components (In this embodiment one transformer and 2 independent virtually uncoupled inductors.

Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and not limitative, in which.

DETAILED DESCRIPTION OF AN EMBODIMENT

Figure 1:
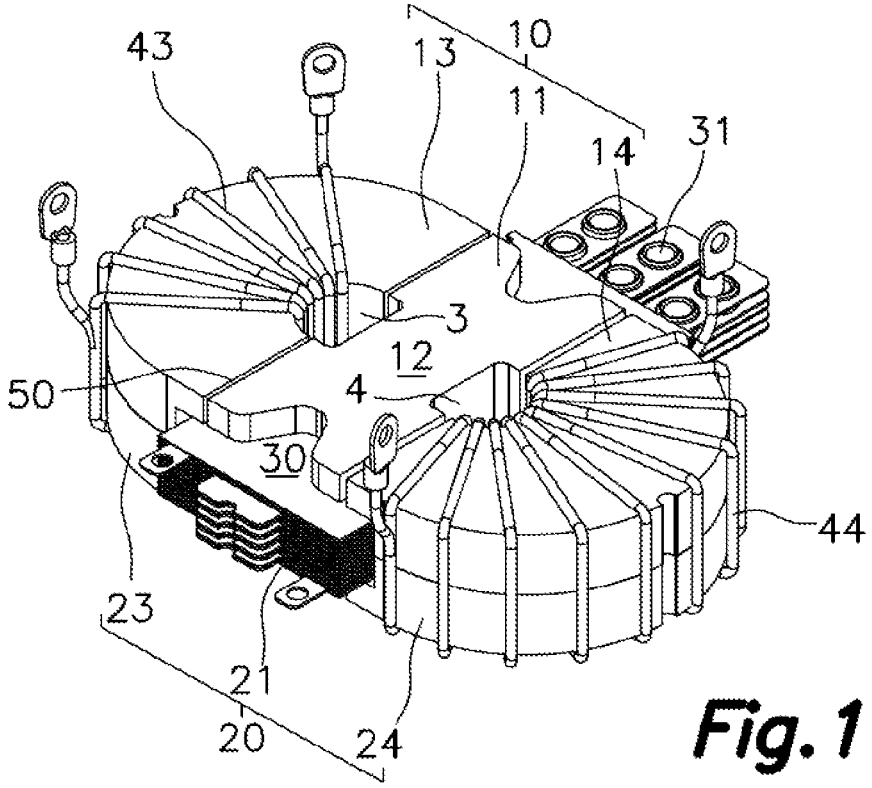
FIG. 1 shows a perspective view of the annular magnetic power unit without the cover made of a mass of insulating polyurethane resin wherein the left outer coil has less windings than the right outer coil.
Figure 2:
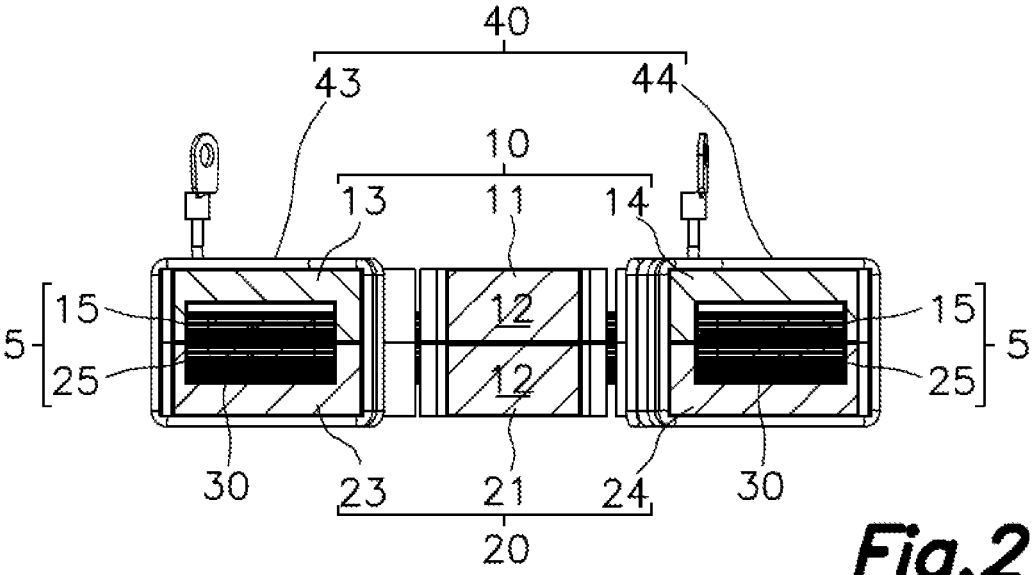
FIG. 2 shows a longitudinal section of the embodiment shown on FIG. 1 being the section made across the left and right inner passages.
Figure 3:
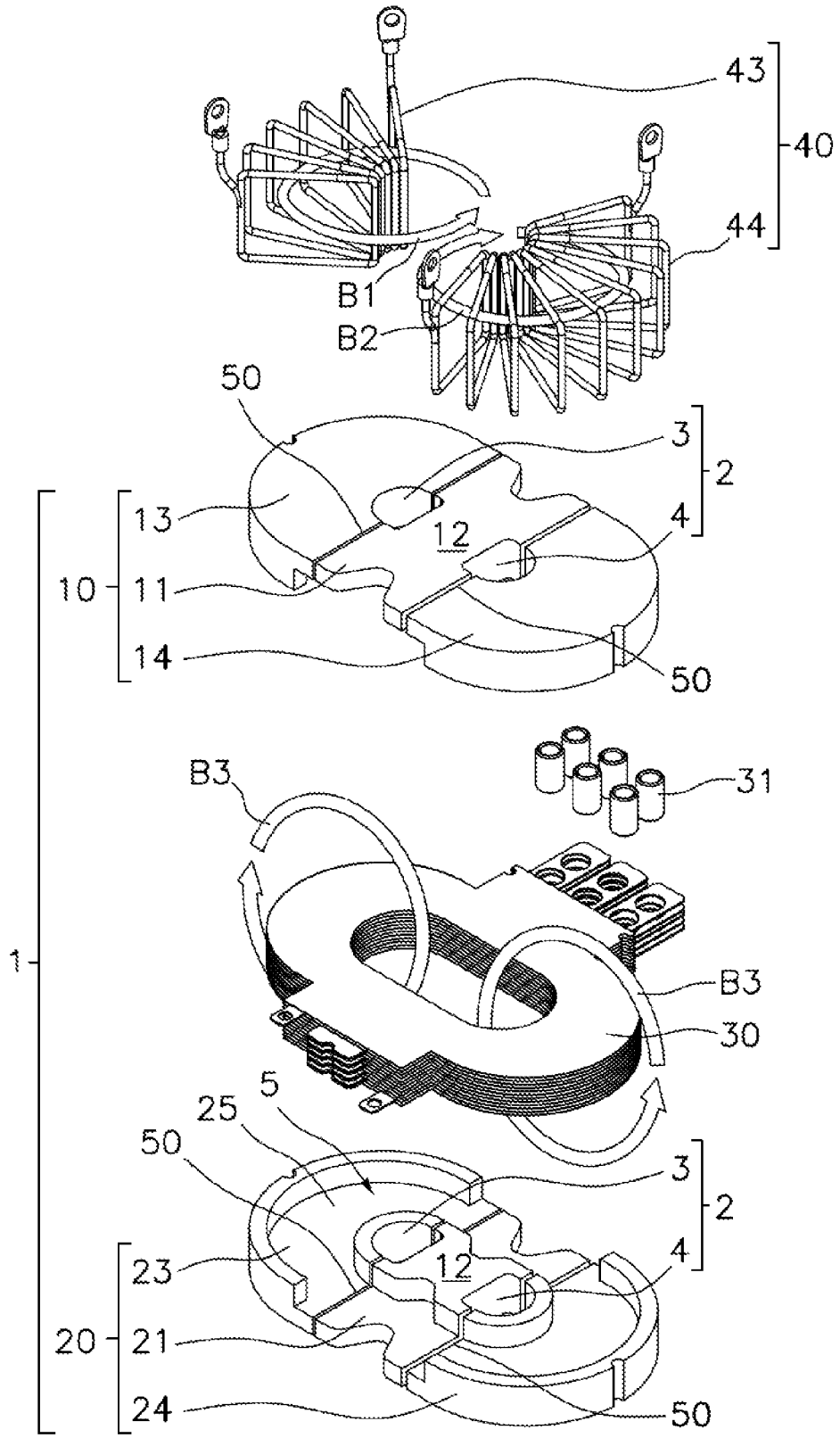
FIG. 3 shows an exploded vision of the annular magnetic power unit shown on FIG. 1, indicating with arrows the magnetic fields associated to each of the outer coils and inner transformer.

The foregoing and other advantages and features will be more fully understood from the following detailed description of an embodiment with reference to the accompanying drawings, to be taken in an illustrative and not limitative, in which:

The present invention corresponds to an annular magnetic power unit which, according to a preferred embodiment shown on FIGS. 1, 2 and 3, includes an annular magnetic core 1 defined around an inner passage 2, which is made of a ferromagnetic material, and including one electro-conductive inner coil 30 encapsulated within an annular groove 5 defined inside the annular magnetic core 1, and two electro-conductive outer coils 40 wound around the annular magnetic core 1 passing each wound through the inner passage 2.

To create said annular groove 5 and to make it accessible for the insertion of the inner coil 30, the annular magnetic core 1 is composed by a first partial magnetic core 10 and a second partial magnetic core 20 overlapped.

First partial magnetic cores 10 include a first annular groove 15 (FIG. 2) surrounding the inner passage 2 accessible through a surface of the first partial magnetic core 10 facing the second partial magnetic core 20.

Second partial magnetic core 20 is symmetric regard the first partial magnetic core 10, and includes a second annular groove 25 (FIG. 2) surrounding the inner passage 2 accessible through a surface of the second partial magnetic core 20 facing the first partial magnetic core 10.

The inner coil 30 is placed in the first and second annular passage 15 and 25, surrounding the inner passage 2 within the annular magnetic core 1.

Furthermore, the annular magnetic core 1 is divided in three portions spaced apart by two parallel air-gaps 50. Each air-gap 50 is defined in a gap plane perpendicular to the surface of the first partial magnetic core 10 facing the second partial magnetic core 20, and therefore said air-gap 50 not interfering the magnetic field B3 generated by the inner coil 30.

As can be seen in FIG. 2, Said two air-gaps 50 divide the first partial magnetic core 10 in a first left partial magnetic core 13, a first right partial magnetic core 14 and a first central partial magnetic core 11 placed in-between, and divide the second partial magnetic core 20 in a second left partial magnetic core 23, a second right partial magnetic core 24 and a second central partial magnetic core 21 placed in-between.

Each of said two gap planes which define the air-gaps 50 cross the inner passage 2. Each the first and the second central partial magnetic core 11 and 21 have a portion on each side of the inner passage 2, and a correspondent first and second bridge 12 connecting said portions across the inner passage 2. Said first and second bridges 12 divide the inner passage 2 in a left inner passage 3 and a right inner passage 4.

According to this description the annular magnetic core 1 is formed by six different parts, three of them corresponding to the first partial magnetic core 10, and other three corresponding to the second partial magnetic core 20.

The two electro-conductive outer coils 40 previously mentioned wound around the annular magnetic core 1 are, according to the present embodiment of the invention, a left outer coil 43 and a right outer coil 44. The left outer coil 43 is wound around the first and second left partial magnetic cores 13 and 23 passing each wound through the left inner passage 3, and the right outer coil 44 is wound around the first and second right partial magnetic cores 14 and 24 passing each wound through the right inner passage 4.

The air-gaps 50 interrupt the magnetic field B1 and B2 generated in the annular magnetic core 1 by the outer coils 40, preventing interferences and inefficiencies.

Being the left outer coil 43 different from the right outer coil 44, its performances will be also different, permitting the annular magnetic unit to be adaptable to different necessities using the left, the right or both outer coils 43, 44.

It is also proposed the inner coil 30 providing a planar transformer being composed by a plurality of windings stacked together with interleaved insulating laminar members as per the method disclosed in the cited WO2004003947.

According to the present embodiment said windings stacked together include variable number of stacked printed circuit boards windings and copper windings.

Each printed circuit board includes a winding circuit printed on one or both faces of it, creating a planar winding.

The copper windings can be produced by a die-cutting process on a copper sheet, creating a planar winding. Alternatively said copper winding can be created by simple bending of a copper yarn.

Each of the windings stacked together include an extension exiting the annular groove 5, protruding from the annular magnetic core 1. Said extensions including aligned orifices where connecting pins 31 are inserted producing the connection between the windings stacked together.

The annular magnetic power unit will be preferably covered with a mass of insulating polyurethane resin (not shown) which isolates electrically the components. More preferably said polyurethane resin penetrates within the annular groove and also penetrates between the stacked windings of the inner coil 30.

In the disclosed embodiment the magnetic power unit will include a planar transformer confined in the inner passage this arrangement in this way assuring a very low leakage inductance having a maximum value of around 2 μH, and two external inductors one operating a parallel external inductor and the second one as a resonant inductor galvanically isolated.

Also, it should be mentioned that left inner passage 3 and a right inner passage 4, also can be used for the insertion there through of a pipe to evacuate heat using the solution exposed in EP16002354 cited in the background.

It will be understood that various parts of one embodiment of the invention can be freely combined with parts described in other embodiments, even being said combination not explicitly described, provided there is no harm in such combination.

The invention claimed is:

1. An annular magnetic power unit comprising:

an annular magnetic core defining an inner passage and an annular groove, said annular magnetic core comprising a first partial magnetic core and a second partial magnetic core, overlapped and facing to each other;

at least said first partial magnetic core having a first annular groove constitutive of said annular groove, accessible through a surface of the first partial magnetic core facing the second partial magnetic core;

said first annular groove surrounding the inner passage;

at least one electro-conductive inner coil included within the annular groove;

at least one electro-conductive outer coil wound around the annular magnetic core passing through the inner passage;

wherein said at least one electro-conductive outer coil comprises two independent electro-conductive outer coils, named left and right independent electro-conductive outer coils;

the first partial magnetic core is divided by two parallel air-gaps in three independent parts corresponding to a first central magnetic core portion, defined between said two parallel air-gaps, to a first left-side core portion and to a first right-side core portion placed on both sides of said first central magnetic core portion;

the second partial magnetic core is also divided by said two parallel air-gaps in three independent parts corresponding to a second central magnetic core portion, defined between said two parallel air-gaps, to a second left-side core portion and to a second right-side core portion placed on both sides of said second central magnetic core portion;

the two-parallel air-gaps are defined by two parallel gap planes perpendicular to a surface of the first partial magnetic core facing the second partial magnetic core, both parallel gap planes passing through the inner passage;

the first central magnetic core portion and the second central magnetic core portion define correspondent first and second bridges across the inner passage, dividing said inner passage in a left inner passage and a right inner passage;

the left electro-conductive outer coil passes through the left inner passage and surrounds the first and second left side core portions; and the right electro-conductive outer coil passes through the right inner passage and surrounds the first and second right side core portions.

2. The annular magnetic power unit according to claim 1, wherein the electro-conductive inner coil comprises a planar transformer constituted by a succession of stacked windings with interleaved insulating laminar members, said stacked windings being connected to each other.

3. The annular magnetic power unit according to claim 2, wherein said succession of stacked windings comprises a variable number of at least one of stacked printed circuit boards windings and copper windings.

4. The annular magnetic power unit according to claim 3, wherein each copper winding is a copper sheet having a sinuous slit or a winded copper yarn.

5. The annular magnetic power unit according to claim 3, wherein each printed circuit board winding includes a sinuous conductive circuit printed on one or both sides of said printed circuit board winding.

6. The annular magnetic power unit according to claim 3, wherein a connection between said stacked windings is produced by connecting pins inserted through aligned orifices of the printed circuit boards windings and the copper windings.

7. The annular magnetic power unit according to claim 1, wherein said second partial magnetic core has a second annular groove also constitutive of said annular groove, accessible through a surface of the second partial magnetic core facing the first partial magnetic core, said second annular groove surrounding the inner passage.

8. The annular magnetic power unit according to claim 7, wherein the first and second partial magnetic cores are symmetrical.

9. The annular magnetic power unit according to claim 1, wherein the left electro-conductive outer coil is different from the right electro-conductive outer coil.

10. The annular magnetic power unit according to claim 1, wherein the annular magnetic core, the left and right independent electro-conductive outer coils, and the electro-conductive inner coil are embedded in a single mass of insulating polyurethane resin which covers the assembly.

* * * * *